US006682442B2

(12) United States Patent
Winfield

(10) Patent No.: US 6,682,442 B2
(45) **Date of Patent: *Jan. 27, 2004**

(54) DIMPLE PATTERNS ON GOLF BALLS

(75) Inventor: Douglas C. Winfield, Mattapoisett, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/779,363

(22) Filed: Feb. 8, 2001

(65) Prior Publication Data

US 2002/0151384 A1 Oct. 17, 2002

(51) Int. Cl.[7] ..... A63B 37/14
(52) U.S. Cl. ..... 473/383; 473/378; 473/379
(58) Field of Search ..... 473/378, 383, 473/379; 40/327

(56) References Cited

U.S. PATENT DOCUMENTS 4,729,861 A * 3/1988 Lynch et al. ..... 264/219
5,046,742 A * 9/1991 Mackey ..... 40/327
5,149,100 A * 9/1992 Melvin et al. ..... 40/327
5,192,079 A * 3/1993 Sun et al. ..... 40/327
5,259,624 A 11/1993 Puckett ..... 273/232
5,308,076 A * 5/1994 Sun ..... 473/383
5,957,786 A * 9/1999 Aoyama ..... 473/379
6,059,671 A * 5/2000 Asakura ..... 473/383

OTHER PUBLICATIONS

Williams, Robert. The Geometrical Foundation of Natural Structure, Dover Pub., Inc. New York. 1979. p. 97.

* cited by examiner

*Primary Examiner*—Paul T. Sewell
*Assistant Examiner*—Tom Duong
(74) *Attorney, Agent, or Firm*—Swidler Berlin Shereff Friedman, LLP

(57) ABSTRACT

Golf balls are disclosed having novel dimple patterns determined by a plurality of connected polygon regions. A method of packing dimples using the connected polygons is also disclosed. For each disclosed dimple pattern, connected polygons extend from a pole of the golf ball towards the parting line. Dimples are positioned on the golf ball surface according to the pattern of connected polygons and then the remaining space of the golf ball is filled with dimples. This results in a golf ball having a dimple pattern that has some uniformity but also some variance.

4 Claims, 6 Drawing Sheets

DIMPLE PATTERNS ON GOLF BALLS

FIELD OF THE INVENTION

The present invention generally relates to golf balls, and more particularly, to a golf ball having improved dimple patterns.

BACKGROUND OF THE INVENTION

Golf balls were originally made with smooth outer surfaces. In the late nineteenth century, players observed that the guttie golf balls traveled further as they got older and more gouged up. The players then began to roughen the surface of new golf balls with a hammer to increase flight distance. Manufacturers soon caught on and began molding non-smooth outer surfaces on golf balls.

By the mid 1900's, almost every golf ball being made had 336 dimples arranged in an octahedral pattern. Generally, these balls had about 60% of their outer surface covered by dimples. In 1983, Titleist introduced the TITLEIST 384, which had 384 dimples that were arranged in an icosahedral pattern. About 76% of its outer surface was covered with dimples. Today's dimpled golf balls travel nearly two times farther than a similar ball without dimples.

The dimples on a golf ball are important in reducing drag and providing lift. Drag is the air resistance that acts on the golf ball in the opposite direction from the balls flight direction. As the ball travels through the air, the air surrounding the ball has different velocities and, thus, different pressures. The air exerts maximum pressure at the stagnation point on the front of the ball. The air then flows over the sides of the ball and has increased velocity and reduced pressure. At some point it separates from the surface of the ball, leaving a large turbulent flow area called the wake that has low pressure. The difference in the high pressure in front of the ball and the low pressure behind the ball slows the ball down. This is the primary source of drag for a golf ball.

The dimples on the ball create a turbulent boundary layer around the ball, i.e., the air in a thin layer adjacent to the ball flows in a turbulent manner. The turbulence energizes the boundary layer and helps the boundary layer stay attached to the golf ball's surface further around the ball to reduce the area of the wake. This greatly increases the pressure behind the ball and substantially reduces the drag.

Lift is the upward force on the ball that is created from a difference in pressure on the top of the ball to the bottom of the ball. The difference in pressure is created by a warpage in the air flow resulting from the ball's back spin. Due to the back spin, the top of the ball moves with the air flow, which delays the separation to a point further rearward. Conversely, the bottom of the ball moves against the air flow, moving the separation point forward. This asymmetrical separation creates an arch in the flow pattern, requiring the air over the top of the ball to move faster, and thus have lower pressure than the air underneath the ball.

Almost every golf ball manufacturer researches dimple patterns in order to increase the distance traveled by a golf ball. A high degree of dimple coverage is beneficial to flight distance, but only if the dimples are of a reasonable size. Dimple coverage gained by filling spaces with tiny dimples is not very effective, since tiny dimples are not good turbulence generators. Most balls today still have many large spaces between dimples or have filled in these spaces with very small dimples that do not create enough turbulence at average golf ball velocities.

There are many patents directed to various dimple patterns. U.S. Pat. No. 5,046,742 discloses uniformly distributed dimple pattern based upon repeated polygons, hexagons and pentagons. Each polygon having a number of vertices that are connected by a number of edges. The golf ball surface is divided into thirty-two geometric shapes, twelve spherical pentagons and twenty spherical hexagons. Dimples of the same or different sizes can be placed in or on the edges of each pentagon and hexagon. This produces a golf ball that has a high degree of symmetry. This patent does not disclose a dimple pattern that is based upon a repeated polygon formation of dimples that extend from the pole to the equator.

U.S. Pat. No. 5,149,100 discloses a golf ball having a dimple pattern where a number of the dimples are organized in hexagon and pentagon formations. Orientation of these dimple formations on the golf ball's outer surface is based upon the parting line, two hemispheres, and two poles of the outer surface. The parting line is located at the equator of the outer surface, there by dividing the outer surface into the two hemispheres. Each hemisphere has a pole positioned at the furthest point on the outer surface from the parting line. The golf ball disclosed in the patent has a dimple pattern with a hexagon formation of dimples radiating outwardly from a dimple centered at each pole, and pentagon formations of dimples interposed between the hexagon formation of dimples and the parting line of the golf ball. The patent does not disclose a dimple pattern that is based upon a repeated polygon formation of dimples that extend from the pole to the equator.

Thus, there continues to be a need for dimple patterns that have a high percentage of dimple coverage. More particularly, there is a need for dimple patterns that do not have large spaces between the dimples. Additionally, there is a need for dimple patterns that do not need to fill in large spaces with very small dimples, which do not create sufficient turbulence.

SUMMARY OF THE INVENTION

The present invention provides a golf ball with an outer surface that has a plurality of dimples positioned according to a pattern comprising a pole polygon, which has designated edges and vertices, centered at a pole of the golf ball with either translated or mirror-images of polygons connected to it that extend toward a parting line of the golf ball.

The present invention also provides for a method of packing dimples on the outer surface of the golf ball according to the above mentioned pattern of connected polygons.

The dimple patterns according to the present invention have dimples of various sizes that are positioned according to a series of connected polygons that originate from a pole polygon and extend toward the parting line. Because the outer surface of the golf ball is not completely covered by polygons, the dimple patterns of the present invention have some uniformity but also some variance. Preferably, the dimple patterns according to the present invention have dimples that cover more than 70% of the golf ball surface and more preferably greater than 75%. Preferably, the total number of dimples is about 300 to about 500 and at least about 60% of the dimples have a diameter of about 0.10 inches or greater. More preferably, at least about 80% of the dimples have a diameter of about 0.10 inches or greater.

An embodiment of the present invention is a golf ball with a polygon based pattern used to create the dimple pattern on the outer surface. The pattern originates from a polygon centered at a pole of a golf ball and branches out as connected translated or mirror-image polygons extend towards the parting line from each edge or vertex. Extending polygons by translation occurs when the next polygon added to the pattern has the same orientation as the previous polygon. Extending polygons by mirror-imaging occurs when the next polygon added to the pattern incorporates the shared designated edge or vertex as part of its structure. Dimples are positioned on the golf ball surface according to the connected polygon pattern. For any dimples which, if placed on the outer surface, were to intersect the parting line, the polygon that is used to position those dimples is replaced with a set of polygon edges. Depending on the pattern of the connected polygons, each set of polygon edges corresponds to the edges of a polygon that would typically extend from the edge of the connected polygons that is closest to the parting line. These sets of polygon edges allow the pattern to extend towards the parting line while not causing dimples that are placed on the pattern to intersect the parting line. If dimples which, if placed on the outer surface, were to intersect the parting line, the set of polygon edges that is used to position those dimples is eliminated. The dimple pattern is then completed with the positioning of dimples on the remaining non-dimpled portion of the golf ball surface while also not having any dimple that intersect the parting line.

Preferably, this embodiment of the present invention is a golf ball with a hexagon based pattern used to create the dimple pattern. The pattern originates from a hexagon centered at a pole, a pole hexagon, and branches as translated hexagons extend towards the parting line from each edge. The hexagons preferably terminate at the parting line. One way to accomplish this is for each branch of hexagons to terminate with an incomplete hexagon. The dimple pattern is then completed by placing dimples of varying sizes on and around the hexagons.

Another embodiment of the present invention is also a hexagon based pattern. This embodiment is formed with dimples placed on a modified hexagonal pyramid pattern. This pattern occurs by extending translated or mirror-imaged hexagons from each edge of a pole hexagon towards the parting line.

Additional embodiments of the present invention are based upon other polygon patterns. One such embodiment comprises dimples placed upon a golf ball surface at positions that correspond to a pattern extending from edges of a first pole square. Another embodiment is comprised of dimples placed upon a golf ball surface at positions that correspond to a pattern extending from edges of a pole pentagon. It is preferred for dimple surface coverage that the dimples are formed such that there is only one great circle path, i.e., the parting line, that does not intersect any dimples. As with the other embodiments, this dimple pattern extends towards the parting line and has no dimples that intersect or cross the parting line.

Further, features and advantages of the invention can be ascertained from the following detailed description that is provided in connection with the drawings described below.

DETAILED DESCRIPTION

Description of the embodiments of the present invention will be for the formation of dimple patterns on a hemisphere of a golf ball. Although not discussed, the pattern is repeated on the golf ball's second hemisphere. The geometric structure or parts thereof mentioned in this application have no physical manifestation upon the golf ball but only act as guides for dimple placement.

Figure 1:
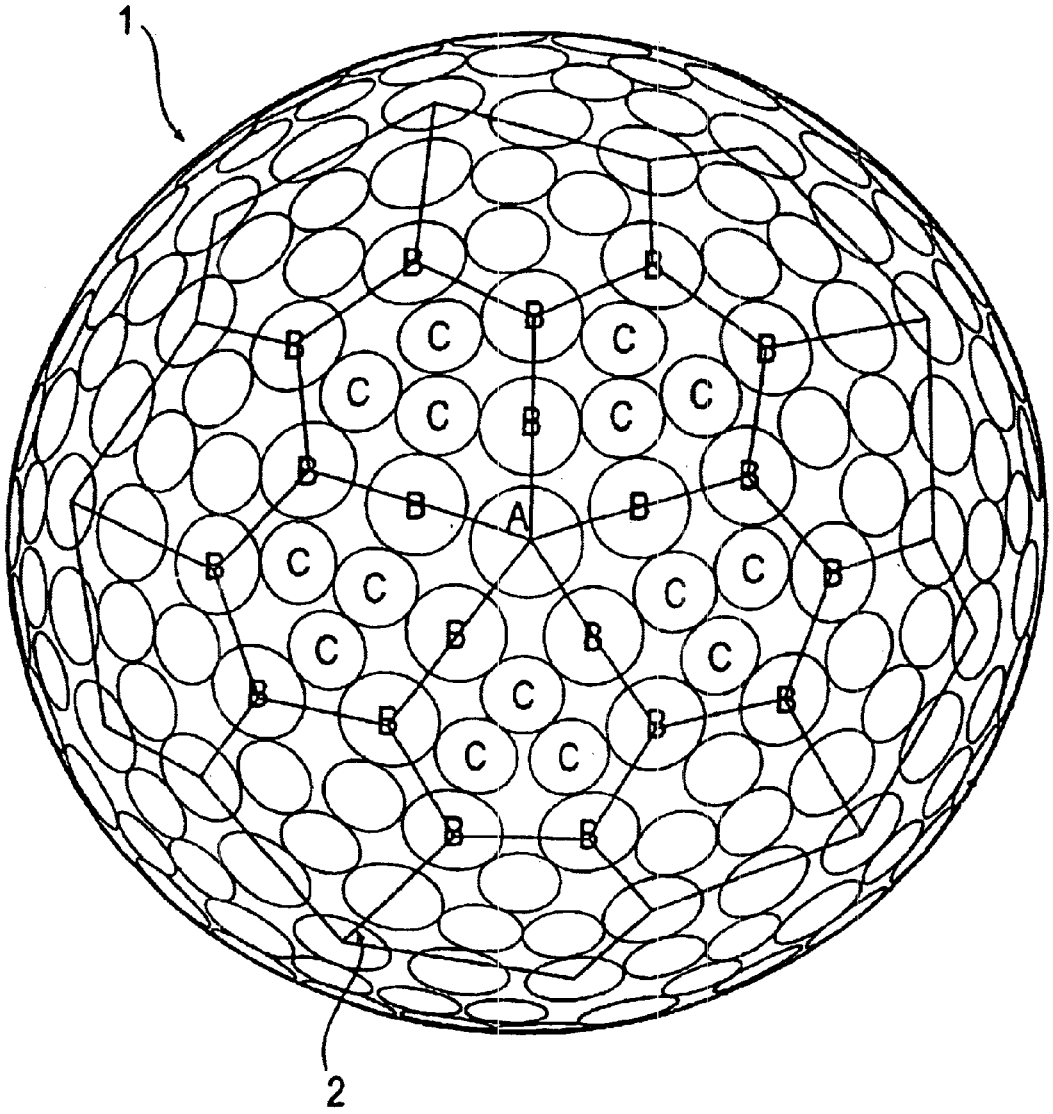
FIG. 1 is a pole view of an embodiment of a golf ball according to the present invention, showing an outer surface, the dimple pattern, the dimple sizes, and a portion of the connected polygon pattern.

FIG. 1 shows a hemisphere of a golf ball's outer surface, which has a dimple pattern corresponding to a embodiment of the claimed invention. The pattern for placement of various sized dimples on the hemisphere is based upon a repeated hexagon pattern with each letter representing a dimple of a specific size. The figure shows the first embodiment from the pole view. Thus, the figure shows a hexagon centered around the pole. Although only one dimple is located at the pole in this embodiment, other embodiments can have zero or multiple dimples located in the regular polygon.

In this embodiment, there are four different sized dimples A–D. Dimple A has a larger diameter than dimple B. Dimple B has a larger diameter than dimple C. Dimple C has a larger diameter than dimple D. The preferred dimple sizes for this embodiment are set forth in Table 1.

TABLE 1

| Dimple | Diameter (inches) |
|---|---|
| A | 0.17 |
| B | 0.16 |
| C | 0.14 |
| D | 0.13 |

The golf balls according to the present invention preferably have at least three different dimple sizes to improve dimple packing. Most preferably, as with this embodiment, the ball includes four to seven different dimple sizes.

It is also important for the dimples to be appropriately sized. Preferably, most of the dimples are about 0.10 inches or larger. The diameter of the dimples should be measured according to the standard method that has been used in the industry for years and is set forth in U.S. Pat. No. 4,936,587, which is incorporated in its entirety by reference herein. More preferably, the dimples range in size from about 0.10 or larger to about 0.20 or less.

Figure 2:
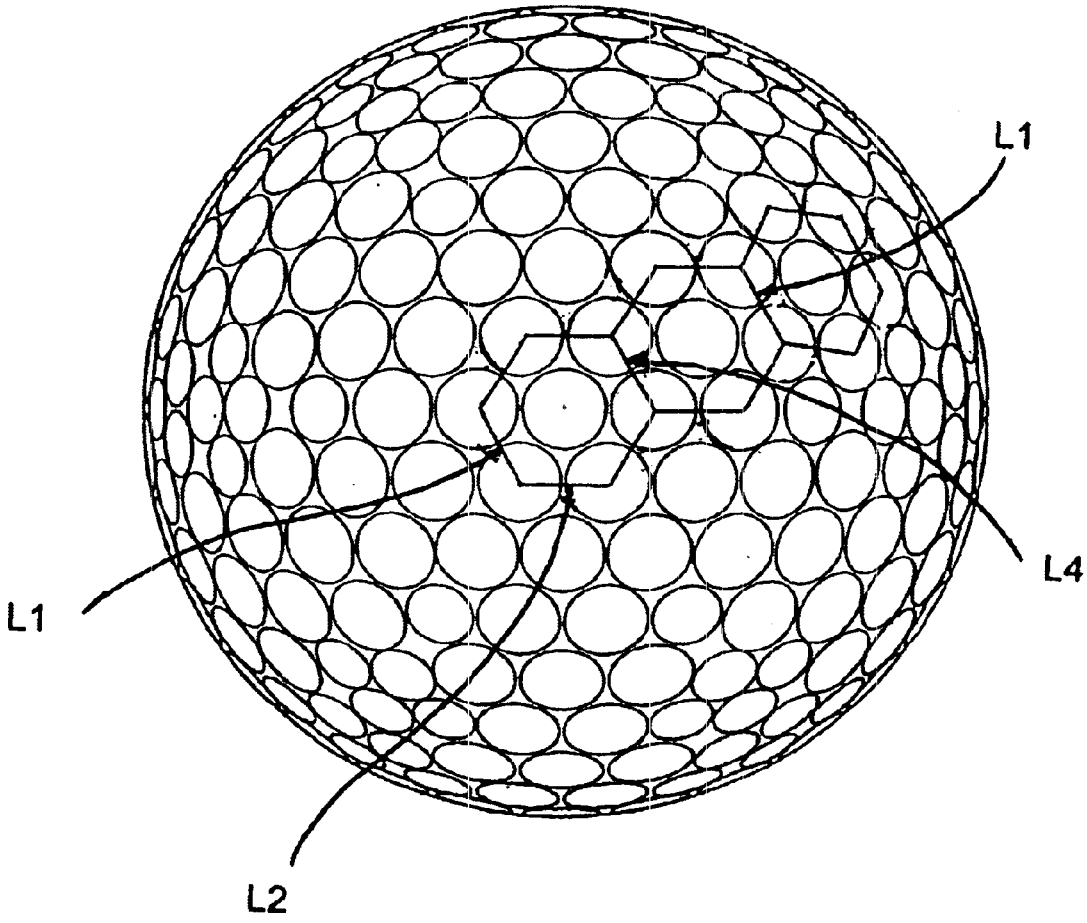
FIG. 2 is a pole view of an embodiment of a golf ball according to the present invention, showing an outer surface, a portion of the polygon pattern, the dimple pattern, and dimple sizes.
Figure 3:
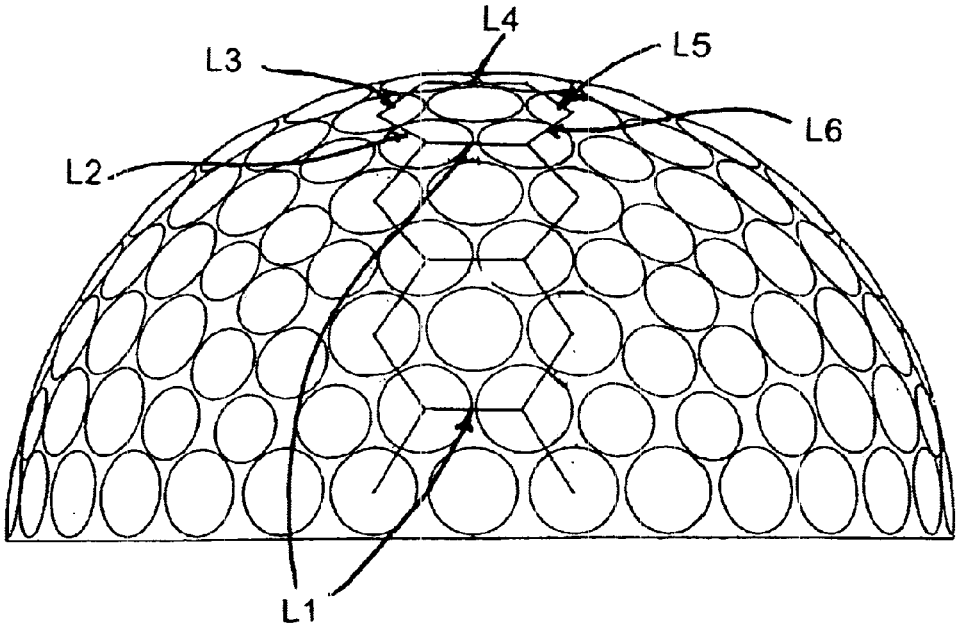
FIG. 3 is a side view of a hemisphere of the golf ball of FIG. 2.
Figure 4:
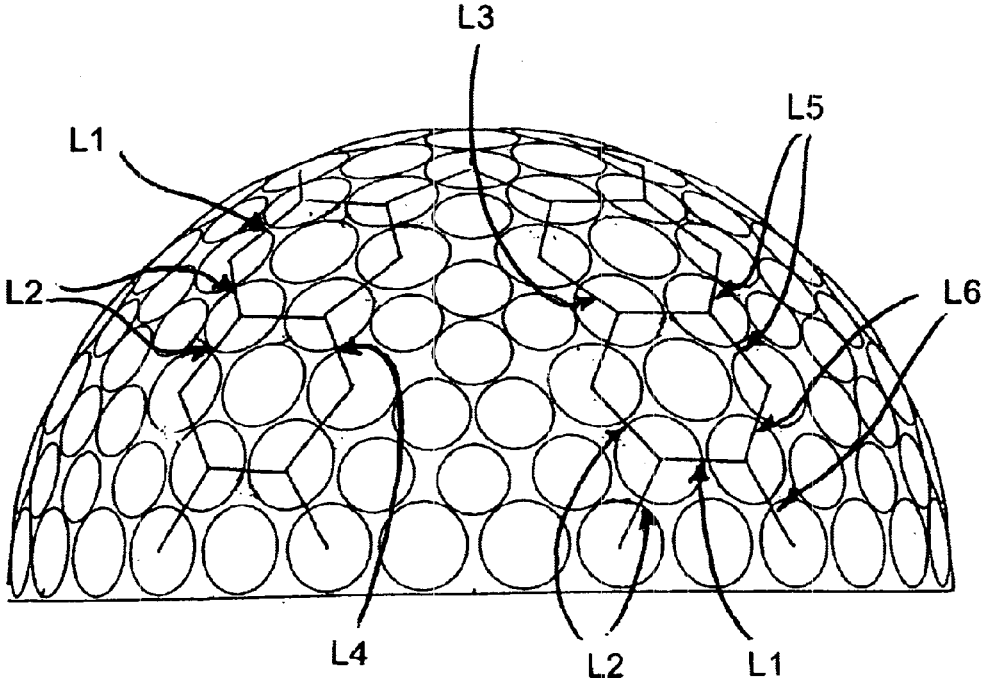
FIG. 4 is a second side view of a hemisphere of the golf ball of FIG. 2.
Figure 5:
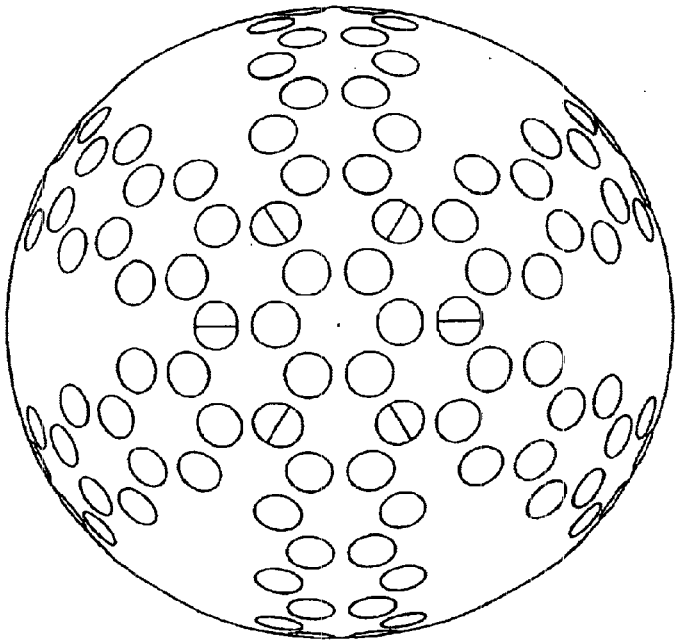
FIG. 5 is a pole view of an embodiment of a golf ball's outer surface and dimples that are positioned at the vertices of a hexagonal pyramid.

FIG. 2 shows how the connected hexagon pattern branches from the golf ball pole to the parting line. A pole hexagon having six edges, L1 through L6, and six vertices, V1 through V6, is centered at the golf ball pole. A first, a second, and a third hexagon of similar size to that of the pole hexagon translate from the L1 edge of the pole hexagon in mirror-image orientation. Because there is not enough room between the L1 edge of the third hexagon and the golf parting line for a fourth hexagon, a set of hexagon edges, L2 and L6, extend from the L1 edge of the third hexagon. In other words, the pattern is continued from the pole, but is then modified near the equator. FIG. 3 shows this pattern of hexagons extending from the pole to the parting line. Five additional branches of the connected hexagon pattern are formed when hexagons are extended from the other edges of the pole hexagon in a manner similar to that previously described. FIG. 4 shows two of those branches that extend from the L4 and L3 edges of the pole hexagon.

A portion of the dimple pattern in this embodiment is formed when A dimples are place at the center and the vertices of each hexagon. For the sets of hexagon edges that extend from the third hexagon of each branch, B dimples are centered at the end of each edge and another B dimple is positioned between those two B dimples as shown in FIG. 4.

Once the regular polygon has been translated to form multiple dimples, the remaining surface is filled with appropriately sized dimples. In this embodiment, FIGS. 1–4 show how those portions of the outer surface that are not covered by dimples are covered with B, C, and D dimples to maximize the number of dimples on the outer surface, reduce drag, and increase lift while no dimples are positioned that would intersect or cross the parting line. The resulting dimple pattern of this embodiment consists of 362 dimples, 182 A dimples, 60 B dimples, 60 C dimples, and 60 D dimples and covers 78.5% of the golf ball hemisphere surface. Preferably, the golf ball has between 300 and 700 total dimples covering more than 70% of the ball's outer surface.

Referring now to FIGS. 5–8, another embodiment of the present invention has a plurality of dimples in a different hexagonal pattern. All of the dimples have a diameter of about 0.10 inches or greater. Dimple A has a greater diameter than dimple B. Dimple B has a greater diameter than dimple C. Dimple C has a greater diameter than dimple D. Dimple D has a greater diameter than dimple E. Dimple E has a greater diameter than dimple F. The preferred dimple sizes are set forth in Table 2.

TABLE 2

| Dimple | Diameter (inches) |
|---|---|
| A | .155 |
| B | .145 |
| C | .14 |
| D | .135 |
| E | .13 |
| F | .10 |

Figure 6:
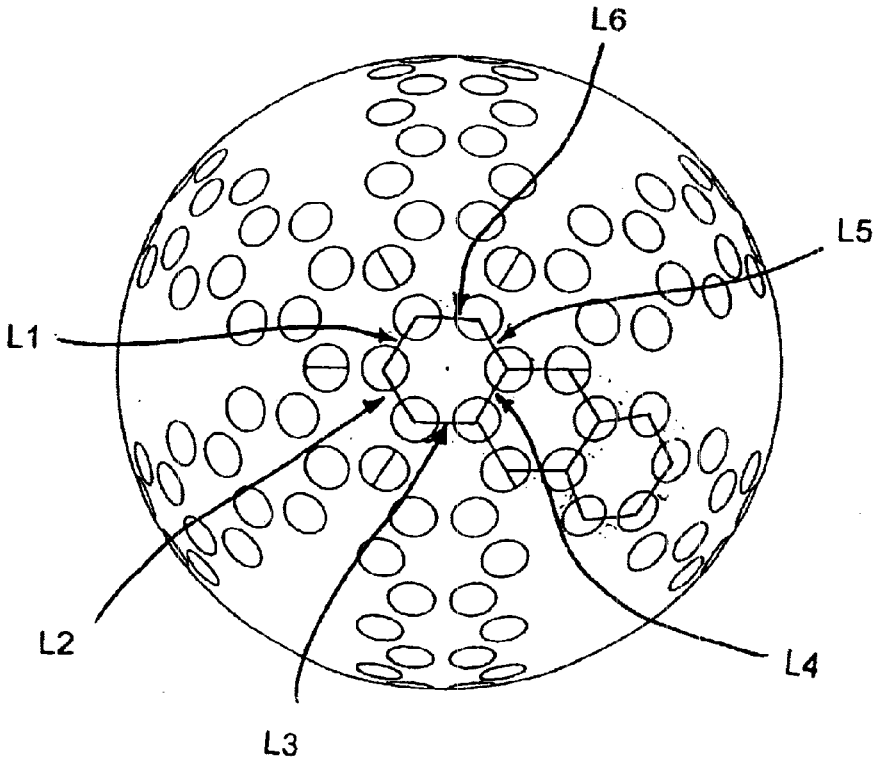
FIG. 6 is a pole view of the golf ball in FIG. 5, showing dimples at the vertices of the hexagonal pyramid, which was created by translating the pole hexagon pattern.
Figure 7:
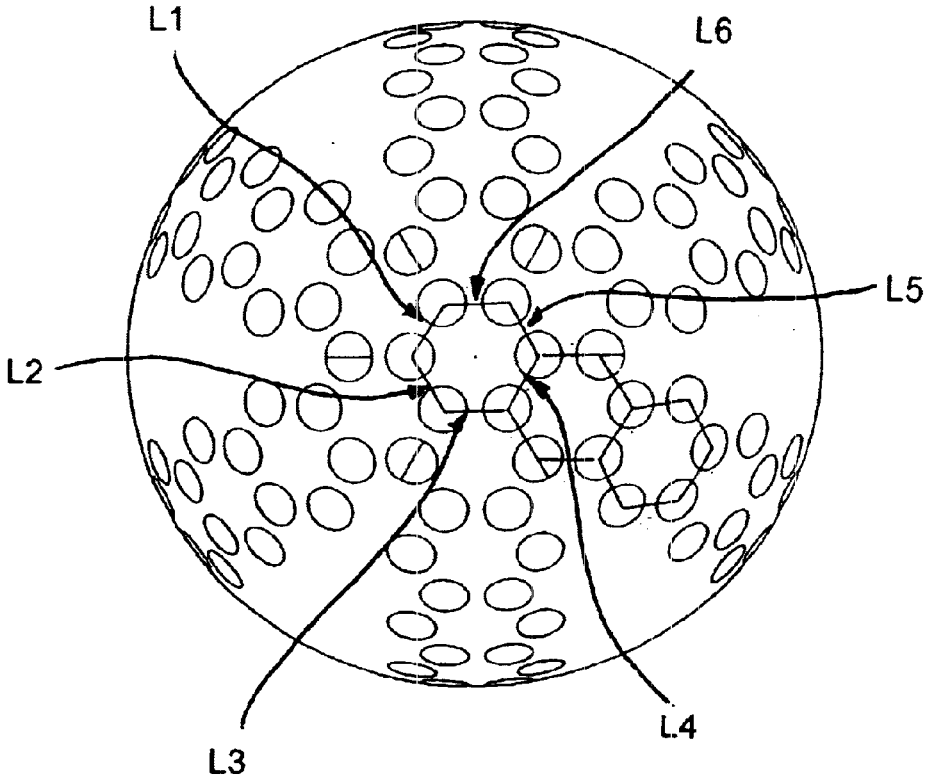
FIG. 7 is a pole view of the golf ball in FIG. 5, showing dimples at the vertices of the hexagonal pyramid, which was created with mirror images of the pole hexagon pattern.
Figure 8:
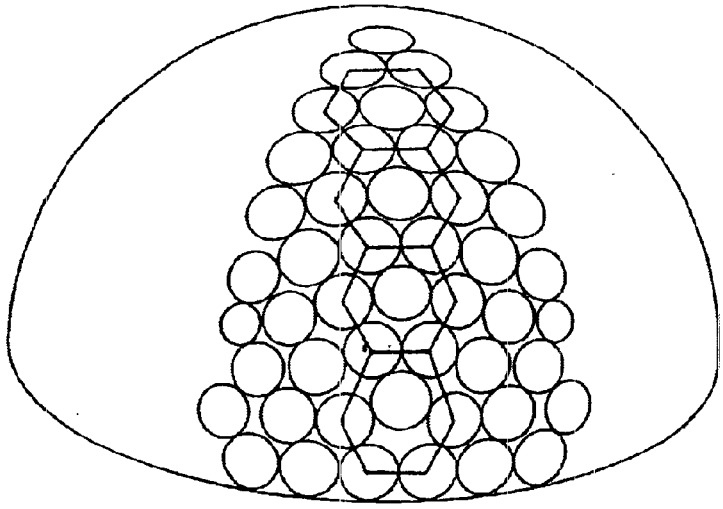
FIG. 8 is a side view of an embodiment of the present invention showing the outer surface of the golf ball, the hexagon pattern, and the arrangement of variously sized dimples.

The second hexagonal pyramid embodiment branches from a pole hexagon centered at a pole of the golf ball outer surface. It has four hexagons translated from each edge of the pole hexagon towards the parting line, as in FIG. 8. The hexagons are translated in a reproducing orientation as shown in FIG. 6 or in a mirror-image orientation, as shown in FIG. 7. As seen in FIG. 8, the shapes of the hexagons, as they extend from the pole hexagon toward the parting line, can be modified so that the dimples arranged on the pattern do not cross the parting line. Also, the sizes of the dimples forming the regular polygons can be modified to provide proper dimple packing. The remaining surface of the golf ball hemisphere is then filled with dimples following the pattern shown in FIG. 8. The resulting dimple pattern on the golf ball hemisphere consists of 235 dimples, 25 A dimples, 60 B dimples, 42 C dimples, and 66 D dimples, 36 E dimples and 6 F dimples covers more than 70% of the golf ball hemisphere surface.

Figure 9:
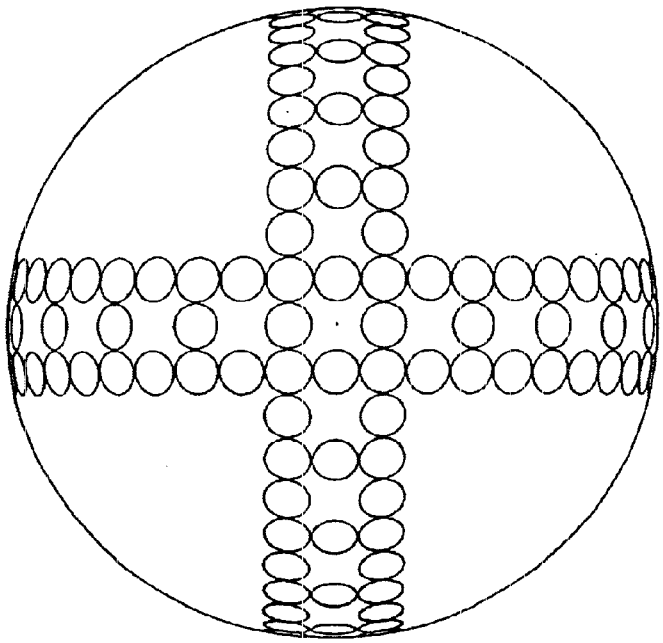
FIG. 9 is a pole view of a golf ball with dimples at the vertices of a two-square offset pattern.
Figure 10:
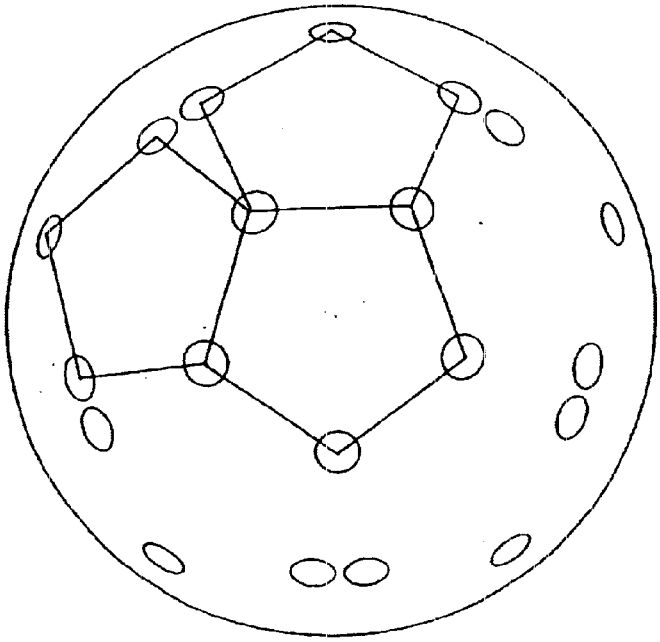
FIG. 10 is a pole view of a golf ball with dimples at the vertices of a pentagonal pattern.

FIGS. 9 and 10 show additional variations of the present invention. As illustrated in FIG. 9, a diamond pattern can be formed around the pole of the ball and repeated in succession by translating the pattern along a point-to-point axis, again either in a reproducing orientation or in a mirror-image orientation. As shown, although not required, the point of one diamond pattern may be defined by a dimple that also defines the point of another pattern. The unused portions of the ball surface that remain after the pattern is repeated on the ball may then be filled with dimples of varying sizes. FIG. 9 illustrates, for example, that the portion of the ball between the points of the diamond pattern, i.e., the portion of the ball not contained by any diamond pattern, may be filled with a dimple similar in size as those used to form the diamond pattern. Depending on the size and location of the dimples forming the pattern, however, this portion of the ball also may have a plurality of dimples or no dimples at all.

Other pattern shapes also may be used in the present invention, such as a pentagonal pattern shown in FIG. 10. In this embodiment, the points of the pentagonal pattern are defined by a dimple. As described in the other embodiments above, the pattern is then repeated around the surface of the ball. FIG. 10 also shows that the dimples that form a point of one pattern may be shared to define a point of another neighboring pattern, although defining the point of more than one pattern with one dimple is not required. As shown in this embodiment, the dimples defining the points of the pattern also may be sufficiently spaced apart from each other so that additional dimples may be provided between each point of the pentagon.

While it is apparent that the illustrative embodiments of the invention herein disclosed fulfill the objectives stated above, it will be appreciated that numerous modifications and other embodiments such as different sized hexagons carry multiple dimples per side may be devised by those skilled in the art. Therefore, it will be understood that the appended claims are intended to cover all such modifications and embodiments which come within the spirit and scope of the present invention.

All patents cited in the foregoing text are expressly incorporated herein by reference in their entirety.

What is claimed is:

1. A golf ball having a spherical surface with a plurality of dimples formed therein, wherein said dimples form a pentagonal hexecontahedron, and wherein the dimples number between 300 and 700.

2. The golf ball of claim 1, wherein the dimples range in size from 0.10 inches to 0.20 inches.

3. A golf ball having an equator, a first hemisphere that has a first pole, and a second hemisphere that has a second pole with both the first and second hemisphere having a plurality of dimples formed therein, the first and second hemisphere comprising a pentagonal hexecontahedron pattern originating from the first and second pole, respectively, and wherein the dimples number between 300 and 700.

4. The golf ball of claim 3, wherein the dimples range in size from 0.10 inches to 0.20 inches.

* * * * *